US011478891B2

(12) United States Patent
Feng

(10) Patent No.: US 11,478,891 B2
(45) Date of Patent: Oct. 25, 2022

(54) KNIFE SHARPENING DEVICE

(71) Applicant: Jianfeng Feng, Shenzhen (CN)

(72) Inventor: Jianfeng Feng, Shenzhen (CN)

( * ) Notice: Subject to any disclaimer, the term of this patent is extended or adjusted under 35 U.S.C. 154(b) by 339 days.

(21) Appl. No.: 16/882,735

(22) Filed: May 25, 2020

(65) Prior Publication Data

US 2021/0053172 A1 Feb. 25, 2021

(30) Foreign Application Priority Data

Aug. 20, 2019 (CN) ..... 201910768728.1

(51) Int. Cl.
*B24B 3/54* (2006.01)
*B24D 15/08* (2006.01)

(52) U.S. Cl.
CPC ..... *B24B 3/54* (2013.01); *B24D 15/081* (2013.01)

(58) Field of Classification Search
CPC ..... B24B 3/54; B24D 15/081
USPC ..... 451/319, 486, 552
See application file for complete search history.

(56) References Cited

U.S. PATENT DOCUMENTS 7,172,500 B1 * 2/2007 Wu ..... B24D 15/081 76/82
8,292,701 B2 * 10/2012 Heng ..... B24B 3/546 451/371
2009/0183601 A1 * 7/2009 Shen ..... B24D 15/02 76/82

* cited by examiner

*Primary Examiner* — Nhat Chieu Q Do
(74) *Attorney, Agent, or Firm* — Jeenam Park

(57) ABSTRACT

A knife sharpening device includes a main housing, a first knife sharpening blade having two first sharpening edges, a second knife sharpening blade having two second longitudinal sharpening edges, and a blade replacement arrangement. The blade replacement arrangement includes a first supporting device movably and inclinedly supported by the main housing, a first knife sharpening blade detachably supported on the first supporting device to expose one of the first sharpening edges out of the first supporting device, a second supporting device movably and inclinedly supported by the main housing to and a second knife sharpening blade being detachably supported on the second supporting device to expose one of the second longitudinal sharpening edges out of the second supporting device.

9 Claims, 10 Drawing Sheets

KNIFE SHARPENING DEVICE

CROSS REFERENCE TO RELATED APPLICATION

This is a non-provisional application which claims priority to a Chinese patent application having application number of CN 201910768728.1, and filing date of Aug. 20, 2019, the entire contents of which is hereby incorporated by reference.

BACKGROUND OF THE PRESENT INVENTION

Field of Invention

The present invention relates to a knife sharpener, and more particularly to a knife sharpening device comprising a blade replacement arrangement which is capable of replacing and facilitating full use of sharpening blades so as to prolong the general lifespan of the sharpening blades and the knife sharpening device as a whole.

Description of Related Arts

A conventional knife sharpener may comprise a plurality of alloy-made sharpening blades for sharpening a cutting blade of a knife. The sharpening blades are inclinedly supported on a housing in such a manner that the sharpening blades form an acute angle of inclination and this create a V-shaped recess for the knife sharpener. When in use, the cutting blade of the knife may be manually disposed in the V-shaped recess and come into contact with the sharpening blades. A user may be able to repetitively grinding the cutting blade against the sharpening blades for sharpening the cutting blade of the knife. Each of the sharpening blades are utilized for sharpening one side of the cutting blade.

A major disadvantage of the above-mentioned conventional knife sharpener is that the sharpening blades are securely affixed in the housing so that it would be very difficult, if not impossible, to replace the sharpening blades. Thus, when the sharpening blades need to be replaced, the user may need to replace the entire knife sharpener.

Moreover, for each of the sharpening blades, since only one side thereof is arranged to come into contact with the cutting blade of the knife, the other side of the corresponding sharpening blade will become idle or useless because it is not designed to have any utility function. The result is that a substantial portion of the sharpening blade may go unused and this represents substantial waste of raw material.

As a result, there is a need to develop a knife sharpening device which is capable of fully utilizing knife sharpening blades and allow convenient replacement thereof.

SUMMARY OF THE PRESENT INVENTION

Certain variations of the present invention provide a knife sharpening device comprising a blade replacement arrangement which is capable of replacing and facilitating full use of sharpening blades so as to prolong the general lifespan of the sharpening blades and the knife sharpening device as a whole.

Certain variations of the present invention provide a knife sharpening device comprising a blade replacement arrangement which allow users to use two longitudinal sharpening edges for a given knife sharpening blade so as to make full use of it for sharpening a cutting blade.

Certain variations of the present invention provide a knife sharpening device comprising a blade replacement arrangement which allows users to replace knife sharpening blades in a very convenient and rapid manner.

In one aspect of the present invention, it provides a knife sharpening device for a knife having a cutting blade, comprising:

a main housing;

a first knife sharpening blade having two first sharpening edges;

a second knife sharpening blade having two second longitudinal sharpening edges; and a blade replacement arrangement, which comprises:

a first supporting device movably and inclinedly supported by the main housing, the first knife sharpening blade being detachably supported on the first supporting device to expose one of the first sharpening edges out of the first supporting device; and a second supporting device movably and inclinedly supported by the main housing, the second knife sharpening blade being detachably supported on the second supporting device to expose one of the second longitudinal sharpening edges out of the second supporting device, the exposed first sharpening edge and the exposed second longitudinal sharpening edge being positioned to face each other to form a substantially V-shaped structure, wherein the cutting blade is adapted for being positioned between the exposed first sharpening edge and the exposed second longitudinal sharpening edge for being sharpened by the exposed first sharpening edge and the exposed second longitudinal sharpening edge.

This summary presented above is provided merely to introduce certain concepts and not to identify any key or essential features of the claimed subject matter.

DETAILED DESCRIPTION OF THE PREFERRED EMBODIMENT

Figure 1:
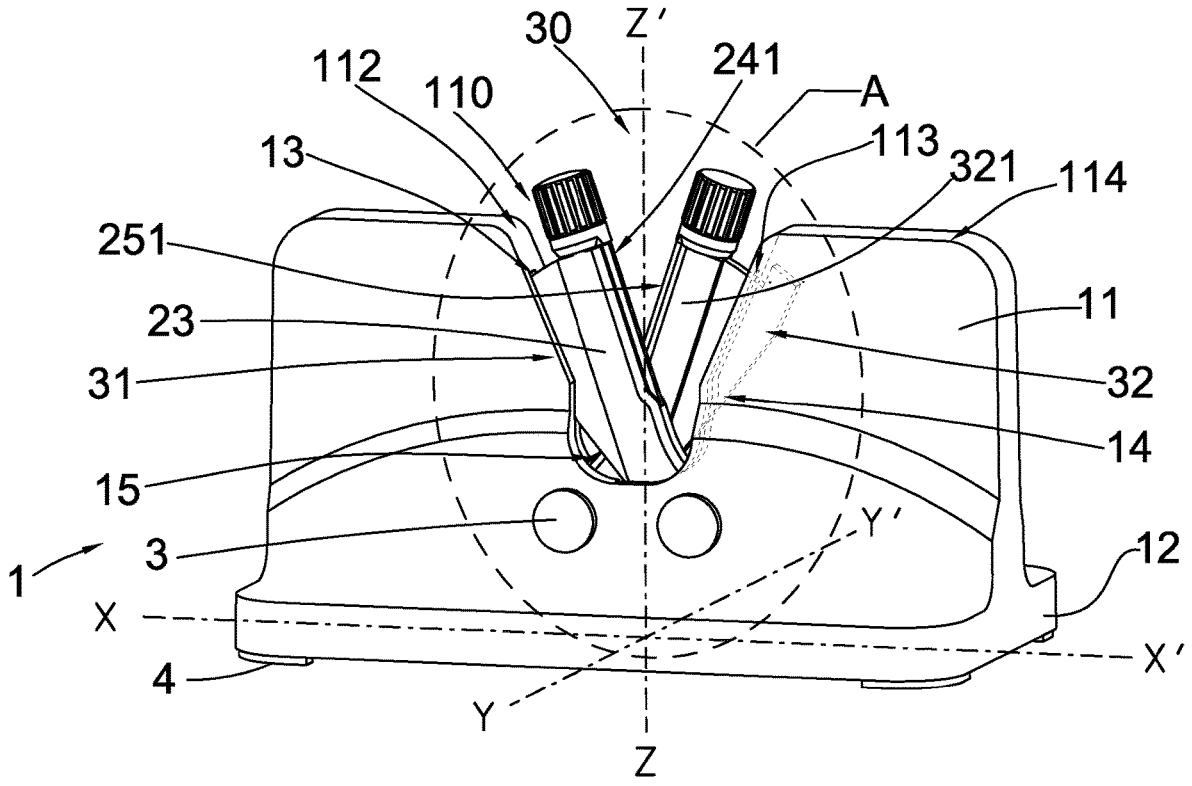
FIG. 1 is a front perspective view of a knife sharpening device according to a first preferred embodiment of the present invention.
Figure 2:
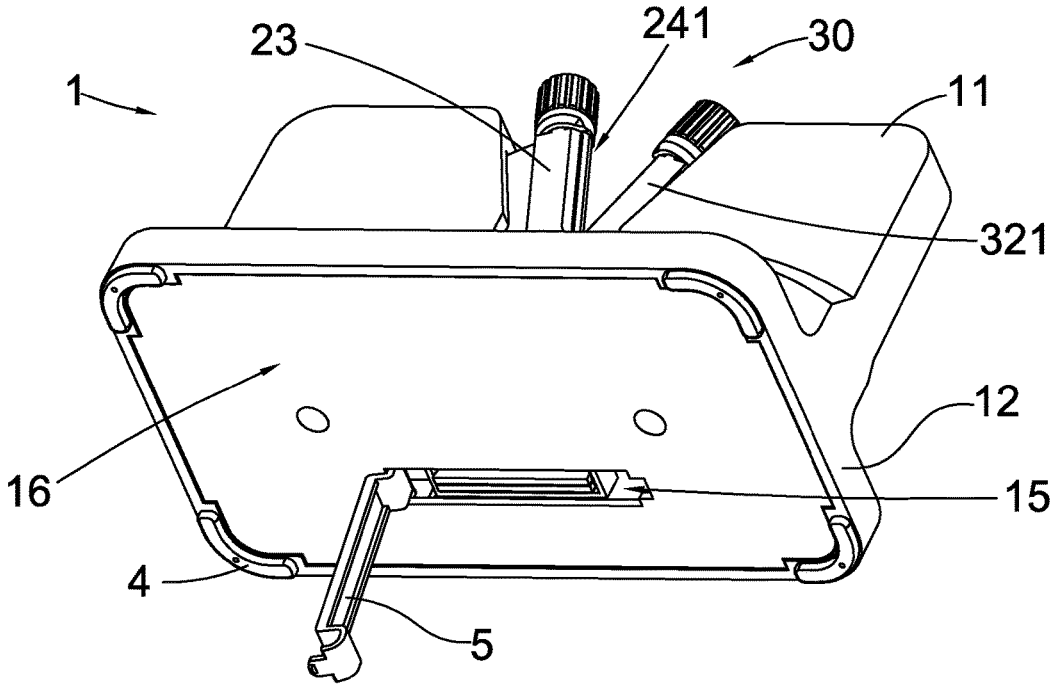
FIG. 2 is a bottom perspective view of the knife sharpening device according to the first preferred embodiment of the present invention.
Figure 3:
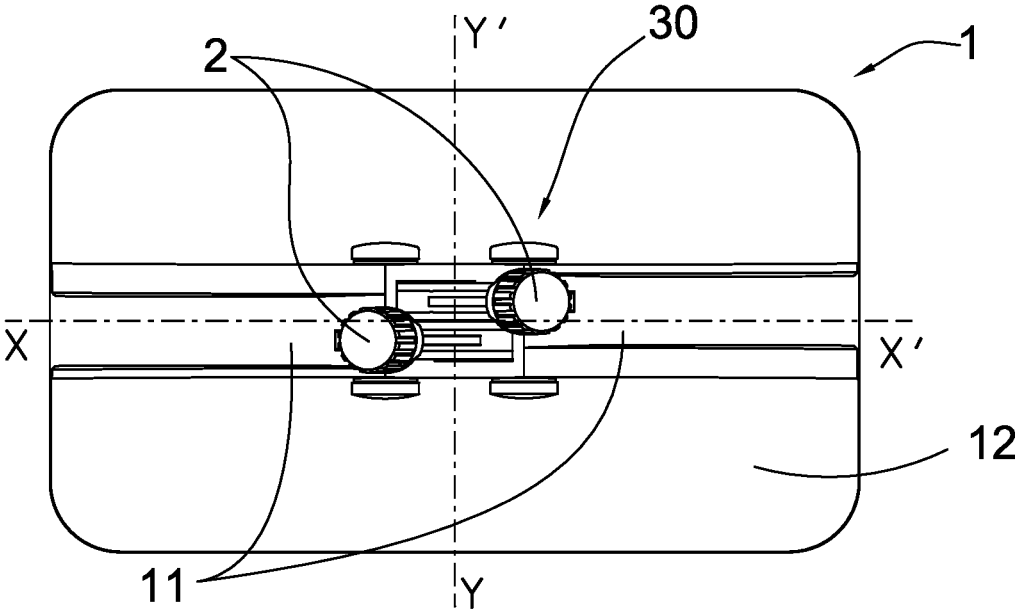
FIG. 3 is top view of the knife sharpening device according to the first preferred embodiment of the present invention.

The following detailed description of the preferred embodiment is the preferred mode of carrying out the invention. The description is not to be taken in any limiting sense. It is presented for the purpose of illustrating the general principles of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Furthermore, "connected" may also mean direct connection or indirect connection, or connection through other auxiliary components. Therefore, the above terms should not be an actual connection limitation of the elements of the present invention.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of the present invention without limiting the actual location or orientation of the present invention. Therefore, the above terms should not be an actual location limitation of the elements of the present invention.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

Referring to FIG. 1 to FIG. 11 of the drawings, a knife sharpening device according to a first preferred embodiment of the present invention is illustrated. Broadly, the knife sharpening device may comprise a main housing 1, a first knife sharpening blade 24, a second knife sharpening blade 25, and a blade replacement arrangement 30. The knife sharpening device of the present invention may be for a knife having a cutting blade.

The first knife sharpening blade 24 may have two first sharpening edges 241. The second knife sharpening blade 25 may have two second longitudinal sharpening edges 251.

The blade replacement arrangement 30 may comprise a first supporting device 31 and a second supporting device 32. The first supporting device 31 may be movably and inclinedly supported by the main housing 1. The first knife sharpening blade 24 may be detachably supported on the first supporting device 31 to expose one of the first sharpening edges 241 out of the first supporting device 31.

The second supporting device 32 may be movably and inclinedly supported by the main housing 1. The second knife sharpening blade 25 may be detachably supported on the second supporting device 32 to expose one of the second sharpening edges 251 out of the second supporting device 25. The exposed first sharpening edge 241 and the exposed second longitudinal sharpening edge 251 may be positioned to face each other to form a substantially V-shaped structure, wherein the cutting blade of a knife is adapted for being positioned between the exposed first sharpening edge 241 and the exposed second longitudinal sharpening edge 242 for being sharpened by the exposed first sharpening edge 241 and the exposed second longitudinal sharpening edge 251.

According to the first preferred embodiment of the present invention, the main housing 1 may comprise a base 12 and an accommodating frame 11 upwardly extended from the base 12. A plurality of supporting legs 4 may be provided on a bottom side of the base 12 for supporting the base 12 and the accommodating frame 11 at a predetermined height above a flat surface.

As shown in FIG. 1 of the drawings, the accommodating frame 11 may have an accommodating recess 110 defined by a first supporting surface 112 and a second supporting surface 113. The first supporting surface 112 and the second supporting surface 113 may inclinedly extend from a top surface 114 of the accommodating frame 11 in such a manner that first supporting surface 112 and the second supporting surface 113 may form an acute angle of inclination with respect to each other. In other words, the accommodating recess 110 may have a substantially V-shaped cross section when viewed from the front, such as that illustrated in FIG. 1 of the drawings.

Moreover, the main housing 1 may further have a first receiving slot 13 and a second receiving slot 14 formed on the first supporting surface 112 and the second supporting surface 113 respectively, wherein the first supporting device 31 and the second supporting device 32 of the blade replacement arrangement 30 may be partially supported in the first receiving slot 13 and the second receiving slot 14 respectively (described in more details below). In addition, the main housing 1 may further have a third receiving slot 15 formed on a bottom portion of the accommodating recess 110. Note that the first receiving slot 13 and the second receiving slot 14 may communicate with the third receiving slot 15 so that they may altogether form a relatively larger space in the main housing 1, wherein the first supporting device 31 and the second supporting device 32 may be supported in this relatively larger space.

The main housing 1 may further have a storage slot 15 and a storage cover 5 mounted on a bottom surface 16 of the main housing 1 for selectively covering the storage slot 15. The storage slot 15 may be formed in the main housing 1 for storing spare knife sharpening blades, so that when either the first knife sharpening blade 24 or the second knife sharpening blade 25 need replacement, a user may be able to retrieve a replacement knife sharpening blade from the storage slot 15.

Figure 10:
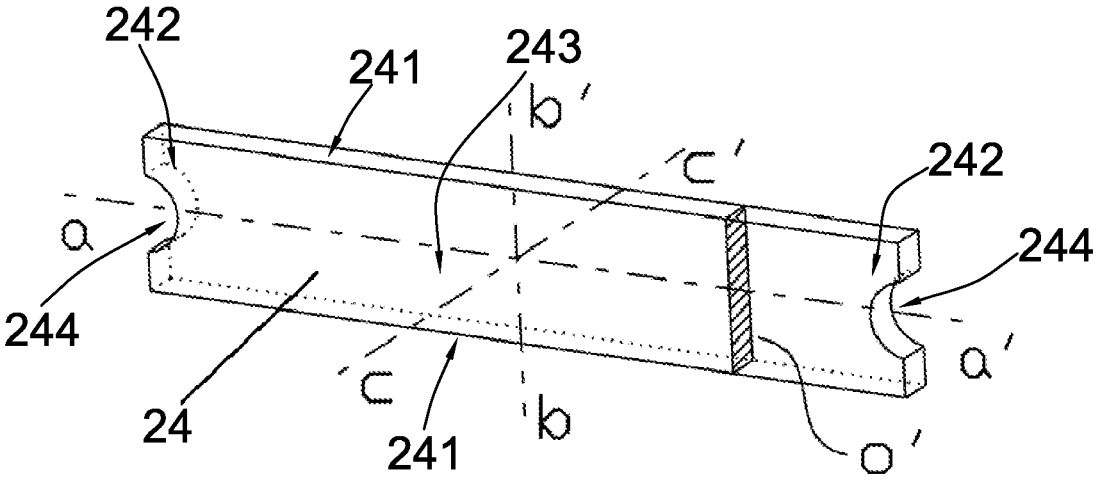
FIG. 10 is a perspective view of a first knife sharpening blade of the knife sharpening device according to the first preferred embodiment of the present invention.
Figure 11:
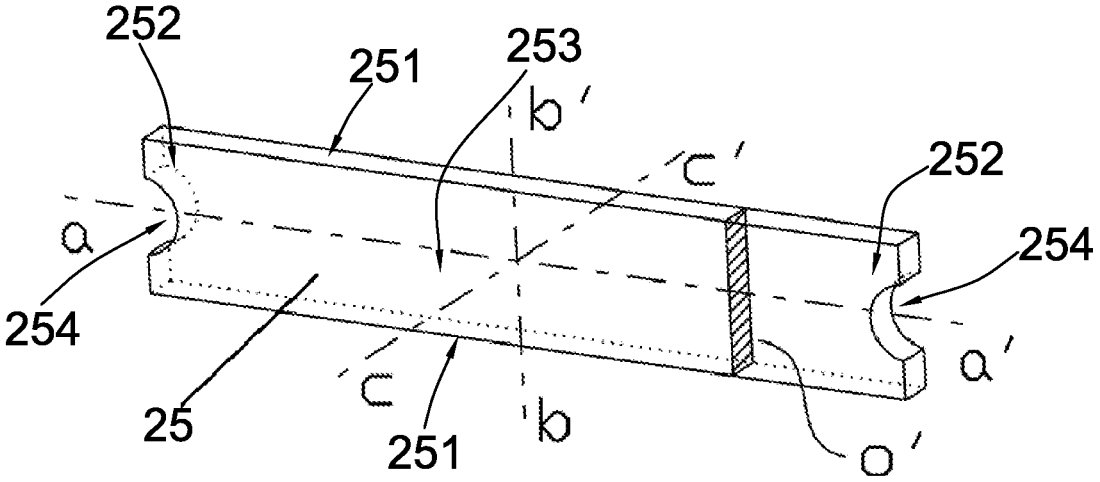
FIG. 11 is a perspective view of a second knife sharpening blade of the knife sharpening device according to the first preferred embodiment of the present invention.

As shown in FIG. 10 and FIG. 11 of the drawings, the first knife sharpening blade 24 may have an elongated structure. As shown in FIG. 10, the first knife sharpening blade 24 may be symmetrical about a longitudinal axis a-a', and a transverse axis b-b'. The first sharpening blade 24 may have a rectangular cross-sectional shape when viewed in the direction toward transverse axis b-b' (i.e. along an entire longitudinal length). The first knife sharpening blade 24 may have two first end portions 243 and a first main portion 242 extending between the two first end portions 243. In this first preferred embodiment, each of the two first end portions 243 of the first knife sharpening blade 24 may have a first indented recess 244.

As shown in FIG. 11 of the drawings, the second knife sharpening blade 25 may be structurally identical to the first knife sharpening blade 24. Thus, the second knife sharpening blade 25 may also have an elongated structure. The second knife sharpening blade 25 may be symmetrical about a longitudinal axis a-a', and a transverse axis b-b'. The second sharpening blade 25 may also have a rectangular cross-sectional shape when viewed in the direction toward transverse axis b-b' (i.e. along an entire longitudinal length). The second knife sharpening blade 25 may have two second end portions 253 and a second main portion 252 extending between the two second end portions 253. In this first preferred embodiment, each of the two second end portions 253 of the second knife sharpening blade 25 may have a second indented recess 254.

The first sharpening edges 241 of the first knife sharpening blade 24 may be formed on the two longitudinal edges of the first main portion 242 of the first knife sharpening blade 24. The first sharpening edges 241 may be configured and crafted to be very sharp and smooth so as to facilitate effective and efficient sharpening of the cutting blade of the knife. The two first sharpening edges 241 may be formed in an opposite side of the first sharpening blade 24 so that when one of the first sharpening edges 241 becomes blunt or not suitable for use, the other one of the first sharpening edges 241 may still be utilized for sharpening the cutting blade.

Similarly, the second sharpening edges 251 of the second knife sharpening blade 25 may be formed on the two longitudinal edges of the first main portion 252 of the second knife sharpening blade 25. The second sharpening edges 251 may be configured and crafted to be very sharp and smooth so as to facilitate effective and efficient sharpening of the cutting blade of the knife. The two second sharpening edges 251 may be formed in an opposite side of the second sharpening blade 25 so that when one of the second sharpening edges 251 becomes blunt or not suitable for use, the other one of the second sharpening edges 251 may still be utilized for sharpening the cutting blade.

The first supporting device 31 may comprise a first supporting frame 23 having a first elongated slot 231, and a first mounting mechanism 311 provided on the first supporting frame 23 to detachably mount the first knife sharpening blade 24 in the first elongated slot 231.

The first mounting mechanism 311 may comprise a first fastening knob 21 and a first fastening ring 22, wherein the first supporting frame 23 may further have a first connecting portion 312 for detachably connecting to the first fastening knob 21. In this first preferred embodiment, the first connecting portion 312 may be externally threaded while the first fastening knob 21 may have a first bored hole 211 for threadedly connecting to the first connecting portion 312 of the first supporting frame 23. The first fastening knob 21 may have a plurality of first slip resistant teeth 212 formed on an external surface thereof for allowing a user to turn the first fastening knob 21 more easily.

Figure 4:
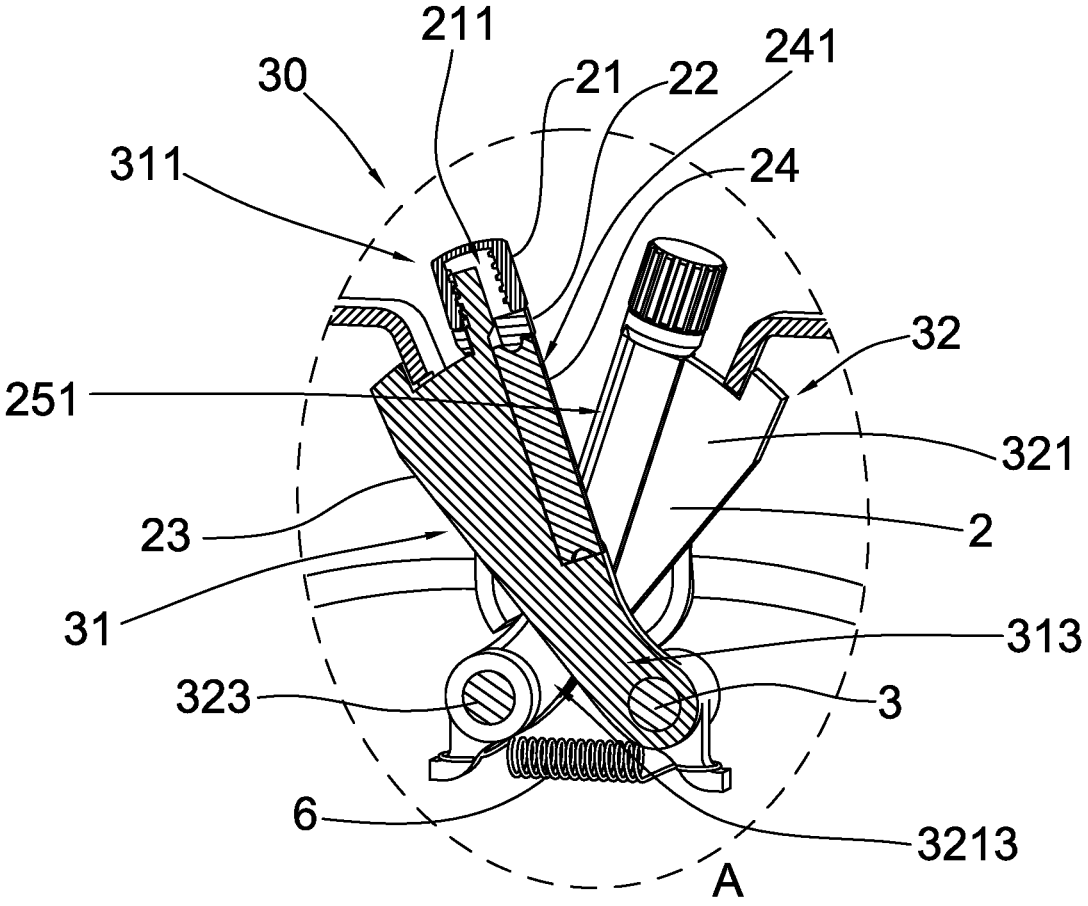
FIG. 4 is a perspective view of a blade replacement arrangement of the knife sharpening device according to the first preferred embodiment of the present invention.
Figure 5:
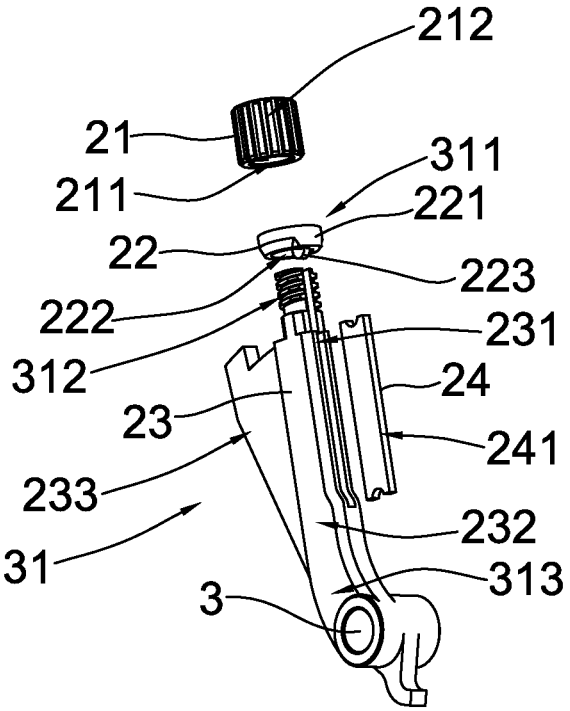
FIG. 5 is a schematic diagram of a first knife sharpening blade and a first supporting device of the knife sharpening device according to the first preferred embodiment of the present invention.
Figure 6:
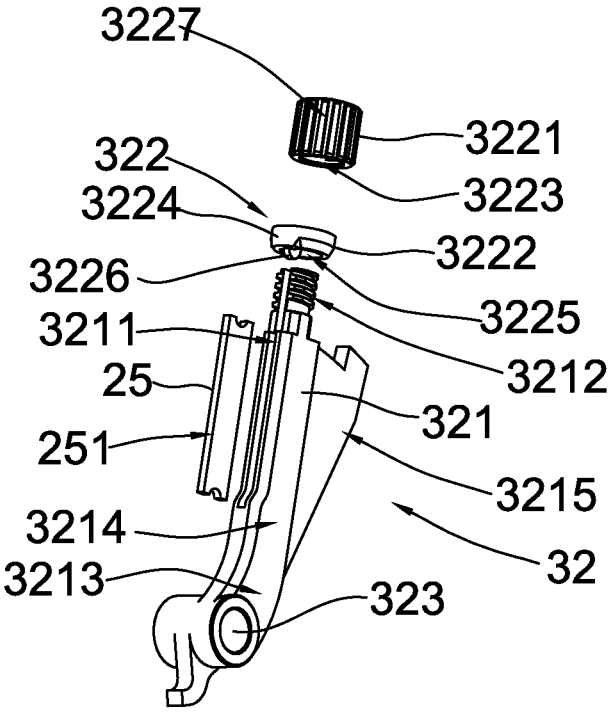
FIG. 6 is a schematic diagram of a second knife sharpening blade and a second supporting device of the knife sharpening device according to the first preferred embodiment of the present invention.
Figure 7:
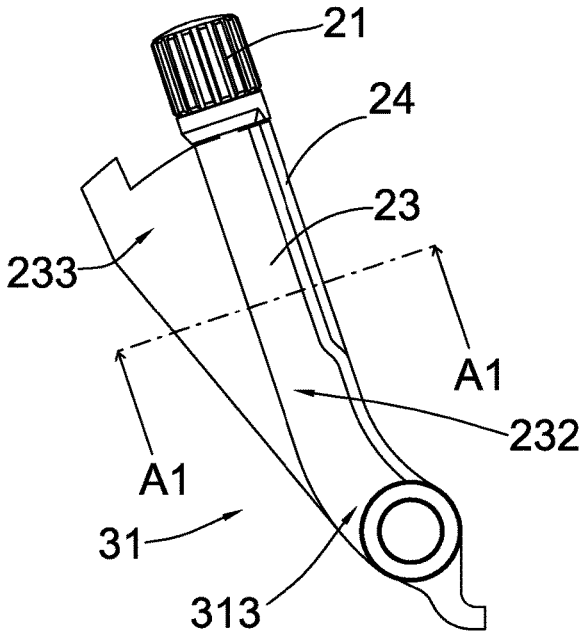
FIG. 7 is a front view of a first supporting device of the knife sharpening device according to the first preferred embodiment of the present invention.
Figure 8:
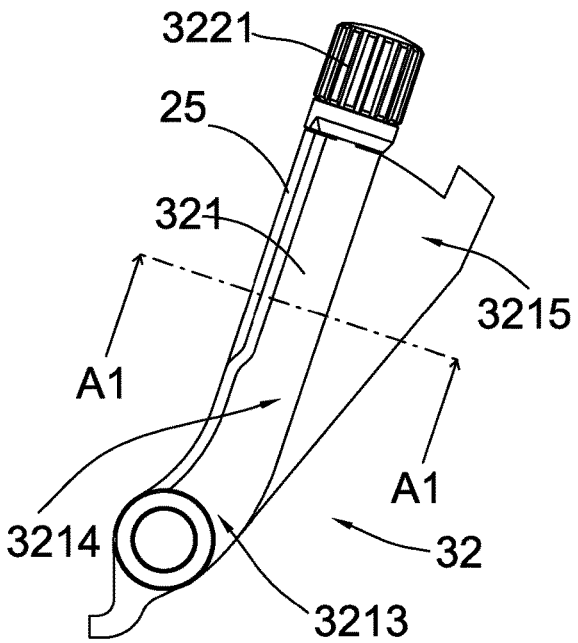
FIG. 8 is a front view of a second supporting device of the knife sharpening device according to the first preferred embodiment of the present invention.
Figure 9:
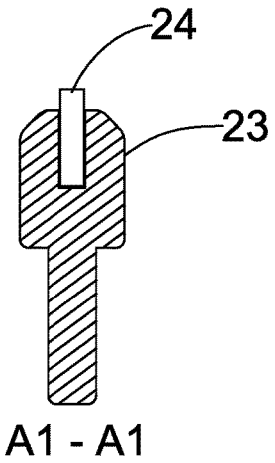
FIG. 9 is a sectional view along plane A1-A1 of FIG. 7.

As shown in FIG. 4 to FIG. 6 of the drawings, the first fastening ring 22 may have a first ring body 221, a through first central opening 222 formed on the first ring body 221, and a first protrusion 223 downwardly extended from the first ring body 221. The first fastening ring 22 may be sandwiched between the first fastening knob 21 and the first supporting frame 23. Accordingly, the first connecting portion 312 may be arranged to penetrate through the first central opening 221 to threadedly connect with the first bored hole 211 of the first fastening knob 21. At the same time, the first protrusion 223 may be positioned to correspond to the first indented recess 254 so that when the first knife sharpening blade 24 is accommodated in the first elongated slot 231, the first fastening knob 21 may be threadedly tightened on the first connecting portion 312 so as to push the first protrusion 223 to bias against a boundary of the first indented recess 254. This configuration may be illustrated in FIG. 5 of the drawings.

Moreover, the first supporting device 31 may further comprise a first pivotal member 3 provided on a first lower portion 313 of the first supporting frame 23 for pivotally connecting the first supporting frame 23 to the main housing 1. Thus, the first supporting device 31 may be able to pivotally move with respect to the main housing 1 about the first pivotal member 3.

Referring to FIG. 6 of the drawings, the second supporting device 32 may be structurally identical to the first supporting device 31. Specifically, the second supporting device 32 may comprise a second supporting frame 321 having a second elongated slot 3211, and a second mounting mechanism 322 provided on the second supporting frame 321 to detachably mount the second knife sharpening blade 25 in the second elongated slot 3211.

The second mounting mechanism 322 may comprise a second fastening knob 3221 and a second fastening ring 3222, wherein the second supporting frame 321 may further have a second connecting portion 3212 for detachably connecting to the second fastening knob 3221. In this first preferred embodiment, the second connecting portion 3212 may be externally threaded while the second fastening knob 3221 may have a second bored hole 3223 for threadedly connecting to the second connecting portion 3212 of the second supporting frame 321. The second fastening knob 3221 may have a plurality of second slip resistant teeth 3227 formed on an external surface thereof for allowing a user to turn the second fastening knob 3221 more easily.

As shown in FIG. 4 to FIG. 6 of the drawings, the second fastening ring 3222 may have a second ring body 3224, a through second central opening 3225 formed on the second ring body 3224, and a second protrusion 3226 downwardly extended from the second ring body 3224. The second fastening ring 3222 may be sandwiched between the second fastening knob 3221 and the second supporting frame 321. Accordingly, the second connecting portion 3212 may be arranged to penetrate through the second central opening 3225 to threadedly connect with the second bored hole 3223 of the second fastening knob 3221. At the same time, the second protrusion 3226 may be positioned to correspond to the second indented recess 254 so that when the second knife sharpening blade 25 is accommodated in the second elongated slot 3211, the second fastening knob 3222 may be threadedly tightened on the second connecting portion 3212 so as to push the second protrusion 3226 to bias against a boundary of the second indented recess 254. This configuration may be illustrated in FIG. 6 of the drawings.

Moreover, the second supporting device 32 may further comprise a second pivotal member 323 provided on a second lower portion 3213 of the second supporting frame 321 for pivotally connecting the second supporting frame 321 to the main housing 1. Thus, the second supporting device 32 may be able to pivotally move with respect to the main housing 1 about the second pivotal member 323.

The blade replacement arrangement 3 may further comprise a resilient element 6 connecting the first lower portion 313 to the second lower portion 3213, wherein the resilient element 6 may exert a compression force toward the first lower portion 313 and the second lower portion 3213. In this first preferred embodiment, the resilient element 6 may be configured as a compression spring.

As shown in FIG. 1 and FIG. 5 of the drawings, the first supporting frame 23 and the second supporting frame 321 may be movably mounted in the main housing 1 to form an acute angle of inclination. The compression force exerted by the resilient element 6 may drive the first supporting frame 23 and the second supporting frame 321 to pivotally move about the first pivotal member 3 and the second pivotal member 323 respectively.

As shown in FIG. 5 to FIG. 6 of the drawings, the first supporting frame 23 further have a first supporting portion 232 and a first securing portion 233 extended from the first supporting portion 232 for partially and movably receiving in the first receiving slot 13 of the main housing 1, wherein the first elongated slot 231 may be formed in the first supporting portion 232. Thus, the first securing portion 233 may be extended in the direction toward the first receiving slot 13, whereas the first connecting portion 312 and the first lower portion 313 may be upwardly and downwardly extended from the first supporting portion 232 respectively.

On the other hand, the second supporting frame 321 further have a second supporting portion 3214 and a second securing portion 3215 extended from the second supporting portion 3214 for partially and movably receiving in the second receiving slot 14 of the main housing 1, wherein the second elongated slot 3211 may be formed in the second supporting portion 3214. Thus, the second securing portion 3215 may be extended in the direction toward the second receiving slot 14, whereas the second connecting portion 3212 and the second lower portion 3213 may be upwardly and downwardly extended from the second supporting portion 3214 respectively.

The operation of the present invention is as follows: a user may be able to dispose a cutting blade of a knife in the space created by the angle of inclination between the first supporting frame 23 and the second supporting frame 32. The cutting blade may be arranged to come into contact with the exposed first sharpening edge 241 and the exposed second sharpening edge 251, so that the user may manually grind the cutting edge by pushing and pulling the cutting blade back and forth against the exposed first sharpening edge 241 and the exposed second sharpening edge 251.

When the knife sharpening procedure is in process, the first supporting frame 23 and the second supporting frame 32 may be subject to the external force exerted by the user. This external force may overcome the resilient force of the resilient element 6 so that the first supporting frame 23 and the second supporting frame 32 may be pivotally moved with respect to the main housing 1. These pivotal movements may be ultimately limited by the first receiving slot 13 and the second receiving slot 14 respectively. Thus, one skilled in the art may appreciate that the angle of inclination between the first supporting frame 23 and the second supporting frame 32 may be affected by the pressured exerted by the user, as well as the elasticity offered by the resilient element 6. The user may adjust the sharpness of the cutting blade by adjusting the pressure exerted on the exposed first sharpening edge 241 and the exposed second sharpening edge 251.

When the exposed first sharpening edge 241 and the exposed second sharpening edge 251 have been utilized for sharpening cutting blade for an extended period of time, they may become blunt. A user may then unscrew the first fastening knob 21 and the second fastening knob 3221 and release the first fastening ring 22 and the second fastening ring 3224 from the first supporting frame 23 and the second supporting frame 32 respectively. After that, the user may be able to detach the first knife sharpening blade 24 and the second knife sharpening blade 25 and re-install them in the first elongated slot 231 and the second elongated slot 3211 in such a manner that unused first sharpening edge 241 and unused second sharpening edge 251 may be arranged to expose out of the first supporting frame 23 and the second supporting frame 32 respectively. The user may then be able to tighten the re-installed first sharpening edge 241 and re-installed second sharpening edge 251 through tightening the first fastening ring 22 and the second fastening ring 3224 and then the first fastening knob 21 and the second fastening knob 3221.

Referring to FIG. 12 to FIG. 19 of the drawings, a knife sharpening device according to a second preferred embodiment of the present invention is illustrated. The second preferred embodiment is structurally similar to the first preferred embodiment. Broadly, the knife sharpening device may comprise a main housing 1', a first knife sharpening blade 24', a second knife sharpening blade 25', and a blade replacement arrangement 30'.

The first knife sharpening blade 24' may have two first sharpening edges 241'. The second knife sharpening blade 25' may have two second sharpening edges 251'.

The blade replacement arrangement 30' may comprise a first supporting device 31' and a second supporting device 32'. The first supporting device 31' may be movably and inclinedly supported by the main housing 1'. The first knife sharpening blade 24' may be detachably supported on the first supporting device 31' to expose one of the first sharpening edges 241' out of the first supporting device 31'.

The second supporting device 32' may be movably and inclinedly supported by the main housing 1'. The second knife sharpening blade 25' may be detachably supported on the second supporting device 32' to expose one of the second sharpening edges 251' out of the second supporting device 25'. The exposed first sharpening edge 241' and the exposed second sharpening edge 251' may be positioned to face each other to form a substantially V-shaped structure, wherein the cutting blade is adapted for being positioned between the exposed first sharpening edge 241' and the exposed second sharping edge 251' for being sharpened by the exposed first sharpening edge 241' and the exposed second sharping edge 251'.

According to the second preferred embodiment of the present invention, the main housing 1' may comprise a base 12' and an accommodating frame 11' upwardly extended from the base 12'. A plurality of supporting legs 4 may be provided on a bottom side of the base 12' for supporting the base 12' and the accommodating frame 11' at a predetermined height above a flat surface.

Figure 13:
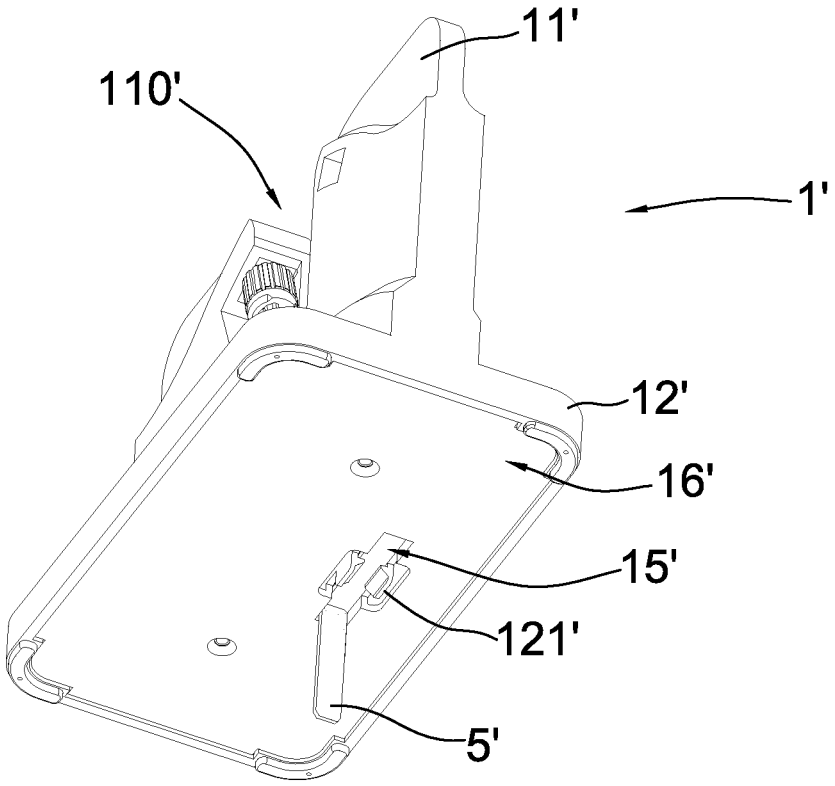
FIG. 13 is a bottom perspective view of the knife sharpening device according to the second preferred embodiment of the present invention.
Figure 15:
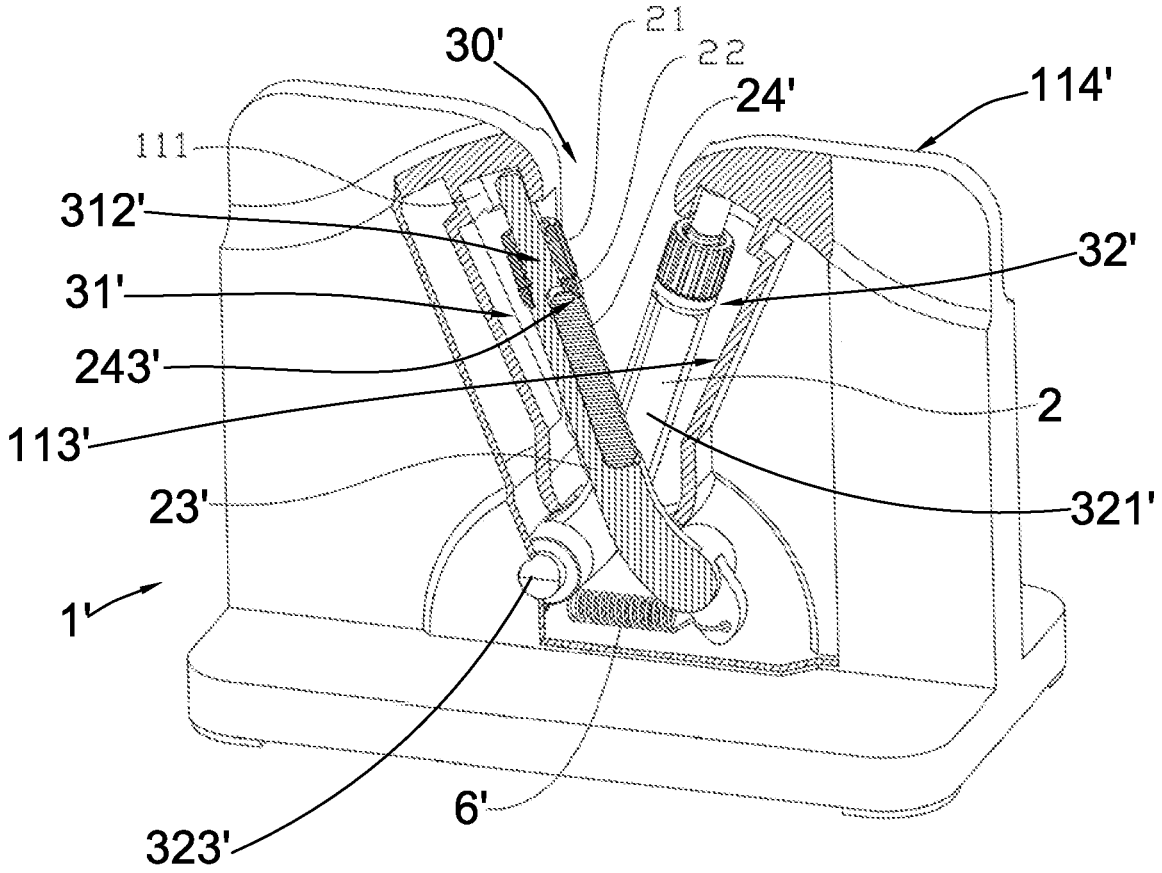
FIG. 15 is a perspective view of a blade replacement arrangement of the knife sharpening device according to the second preferred embodiment of the present invention.

As shown in FIG. 13 and FIG. 15 of the drawings, the accommodating frame 11' may have an accommodating recess 110' defined by a first supporting surface 112' and a second supporting surface 113'. The first supporting surface 112' and the second supporting surface 113' may inclinedly extend from a top portion 114' of the accommodating frame 11' in such a manner that the first supporting surface 112' and the second supporting surface 113' may form an acute angle of inclination with respect to each other. Each of the first supporting device 31' and the second supporting device 32' may be inclinedly mounted in the accommodating recess 110'.

The main housing 1' may further have a storage slot 15' and a storage cover 5' mounted on a bottom surface 16' of the main housing 1' for selectively covering the storage slot 15'. The storage slot 15' may be formed in the main housing 1' for storing spare knife sharpening blades through a holding clip 121', so that when either the first knife sharpening blade 24' or the second knife sharpening blade 25' need replacement, a user may be able to retrieve a replacement knife sharpening blade from the storage slot 15'.

Figure 18:
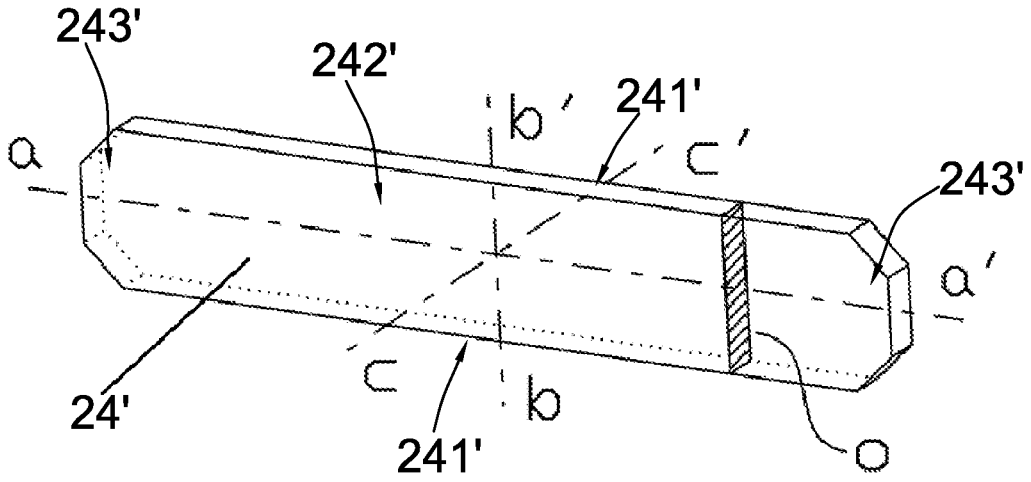
FIG. 18 is a perspective view of a first knife sharpening blade of the knife sharpening device according to the second preferred embodiment of the present invention.
Figure 19:
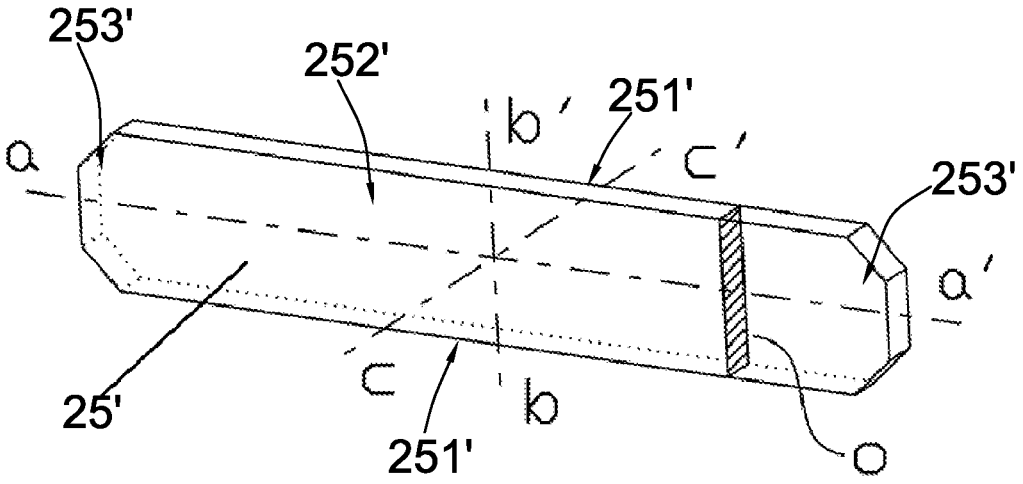
FIG. 19 is a perspective view of a second knife sharpening blade of the knife sharpening device according to the second preferred embodiment of the present invention.

As shown in FIG. 18 and FIG. 19 of the drawings, the first knife sharpening blade 24' may have an elongated structure. The first knife sharpening blade 24' may be symmetric about a longitudinal axis a-a', and a transverse axis b-b'. The first sharpening blade 24' may have a rectangular cross-sectional shape when viewed in the direction toward transverse axis b-b' (i.e. along an entire longitudinal length). The first knife sharpening blade 24' may have two first end portions 243' and a first main portion 242' extending between the two first end portions 243'. In the second preferred embodiment, each of the two first end portions 243' of the first knife sharpening blade 24' may be configured as having a trapezoidal cross-sectional shape.

The second knife sharpening blade 25' may be structurally identical to the first knife sharpening blade 24'. Thus, the second knife sharpening blade 25' may also have an elongated structure. The second knife sharpening blade 25' may be symmetric about a longitudinal axis a-a', and a transverse axis b-b'. The second sharpening blade 25' may also have a rectangular cross-sectional shape when viewed in the direction toward transverse axis b-b' (i.e. along an entire longitudinal length). The second knife sharpening blade 25' may have two second end portions 253' and a second main portion 252' extending between the two second end portions 253'. In this second preferred embodiment, each of the two second end portions 253' of the second knife sharpening blade 25' may be configured as having a trapezoidal cross-sectional shape.

The first sharpening edges 241' of the first knife sharpening blade 24' may be formed on the two longitudinal edges of the first main portion 242' of the first knife sharpening blade 24'. The first sharpening edges 241' may be configured and crafted to be very sharp and smooth so as to facilitate effective and efficient sharpening of the cutting blade of the knife. The two first sharpening edges 241' may be formed in an opposite side of the first sharpening blade 24' so that when one of the first sharpening edges 241' becomes blunt or not suitable for use, the other one of the first sharpening edges 241' may still be utilized for sharpening the cutting blade.

Similarly, the second sharpening edges 251' of the second knife sharpening blade 25 may be formed on the two longitudinal edges of the first main portion 252' of the second knife sharpening blade 25'. The second sharpening edges 251' may be configured and crafted to be very sharp and smooth so as to facilitate effective and efficient sharpening of the cutting blade of the knife. The two second sharpening edges 251' may be formed in an opposite side of the second sharpening blade 25' so that when one of the second sharpening edges 251' becomes blunt or not suitable for use, the other one of the second sharpening edges 251' may still be utilized for sharpening the cutting blade.

The first supporting device 31' may comprise a first supporting frame 23' having a first elongated slot 231', and a first mounting mechanism 311' provided on the first supporting frame 23' to detachably mount the first knife sharpening blade 24' in the first elongated slot 231'.

The first mounting mechanism 311' may comprise a first fastening knob 21' and a first fastening ring 22', wherein the first supporting frame 23' may further have a first connecting portion 312' for detachably connecting to the first fastening knob 21'. In this second preferred embodiment, the first connecting portion 312' may be externally threaded while the first fastening knob 21' may have a first bored hole 211' for threadedly connecting to the first connecting portion 312' of the first supporting frame 23'. The first fastening knob 21' may have a plurality of first slip resistant teeth 212' formed on an external surface thereof for allowing a user to turn the first fastening knob 21' more easily.

Figure 16:
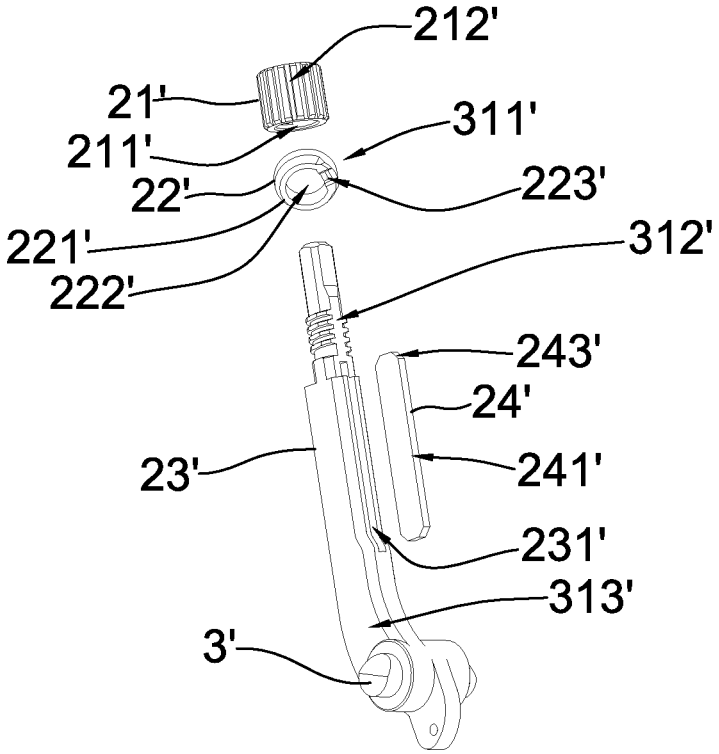
FIG. 16 is a front view of a first supporting device of the knife sharpening device according to the second preferred embodiment of the present invention.
Figure 17:
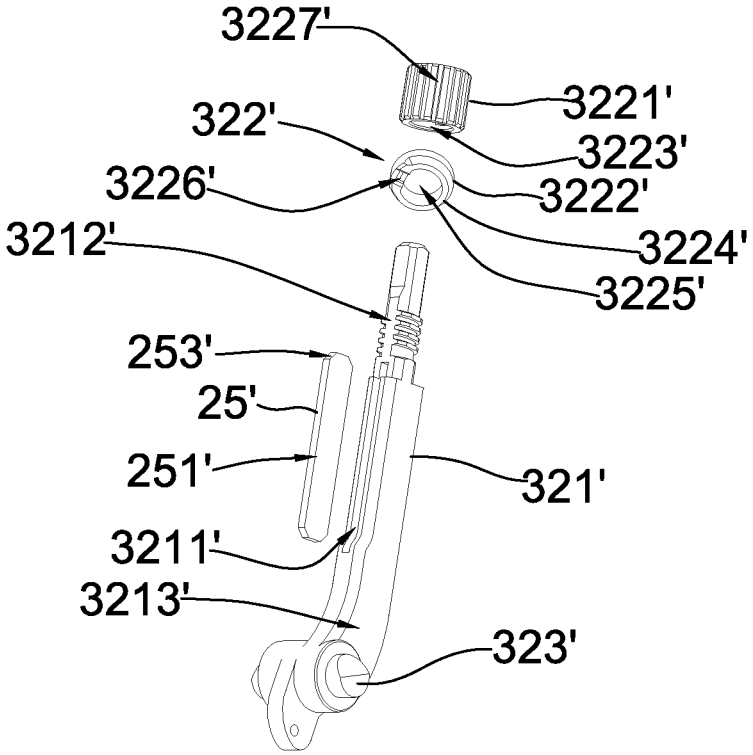
FIG. 17 is a front view of a second supporting device of the knife sharpening device according to the second preferred embodiment of the present invention.

As shown in FIG. 15 to FIG. 17 of the drawings, the first fastening ring 22' may have a first ring body 221', a through first central opening 222' formed on the first ring body 221', and a first indention 223' formed on the first ring body 221'. The first fastening ring 22' may be sandwiched between the first fastening knob 21' and the first supporting frame 23'. Accordingly, the first connecting portion 312' may be arranged to penetrate through the first central opening 221' to threadedly connect with the first bored hole 211' of the first fastening knob 21'. At the same time, the first indention 223' may be positioned to correspond to the corresponding first end portion 243' (having a trapezoidal cross sectional shape) so that when the first knife sharpening blade 24' is accommodated in the first elongated slot 231', the first fastening knob 21' may be threadedly tightened on the first connecting portion 312' so as to push side edges of the first end portion 243' against a boundary wall of the first indention 223'. This configuration may be illustrated in FIG. 15 of the drawings.

Moreover, the first supporting device 31' may further comprise a first pivotal member 3' provided on a first lower portion 313' of the first supporting frame 23' for pivotally connecting the first supporting frame 23' to the main housing 1'. Thus, the first supporting device 31' may be able to pivotally move with respect to the main housing 1' about the first pivotal member 3'.

Referring to FIG. 17 of the drawings, the second supporting device 32' may be structurally identical to the first supporting device 31'. Specifically, the second supporting device 32' may comprise a second supporting frame 321' having a second elongated slot 3211', and a second mounting mechanism 322' provided on the second supporting frame 321' to detachably mount the second knife sharpening blade 25' in the second elongated slot 3211'.

The second mounting mechanism 322' may comprise a second fastening knob 3221' and a second fastening ring 3222', wherein the second supporting frame 321' may further have a second connecting portion 3212' for detachably connecting to the second fastening knob 3221'. In this second preferred embodiment, the second connecting portion 3212' may be externally threaded while the second fastening knob 3221' may have a second bored hole 3223' for threadedly connecting to the second connecting portion 3212' of the second supporting frame 321'. The second fastening knob 3221' may have a plurality of second slip resistant teeth 3227' formed on an external surface thereof for allowing a user to turn the second fastening knob 3221' more easily.

The second fastening ring 3222' may have a second ring body 3224', a through second central opening 3225' formed on the second ring body 3224', and a second indention 3226' downwardly extended from the second ring body 3224'. The second fastening ring 3222' may be sandwiched between the second fastening knob 3221' and the second supporting frame 321'. Accordingly, the second connecting portion 3212' may be arranged to penetrate through the second central opening 3225' to threadedly connect with the second bored hole 3223' of the second fastening knob 3221'. At the same time, the second indention 3226' may be positioned to correspond to the corresponding second end portion 253' (having a trapezoidal cross sectional shape) so that when the second knife sharpening blade 25' is accommodated in the second elongated slot 3211', the second fastening knob 3221' may be threadedly tightened on the second connecting portion 3212' so as to push side edges of the second end portion 253' against a boundary wall of the second indention 3226'.

Moreover, the second supporting device 32' may further comprise a second pivotal member 323' provided on a second lower portion 3213' of the second supporting frame 321' for pivotally connecting the second supporting frame 321' to the main housing 1'. Thus, the second supporting device 32' may be able to pivotally move with respect to the main housing 1' about the second pivotal member 323'.

The blade replacement arrangement 3' may further comprise a resilient element 6' connecting the first lower portion 313' to the second lower portion 3213', wherein the resilient element 6' may exert a compression force toward the first lower portion 313' and the second lower portion 3213'. In this second preferred embodiment, the resilient element 6' may be configured as a compression spring.

Figure 12:
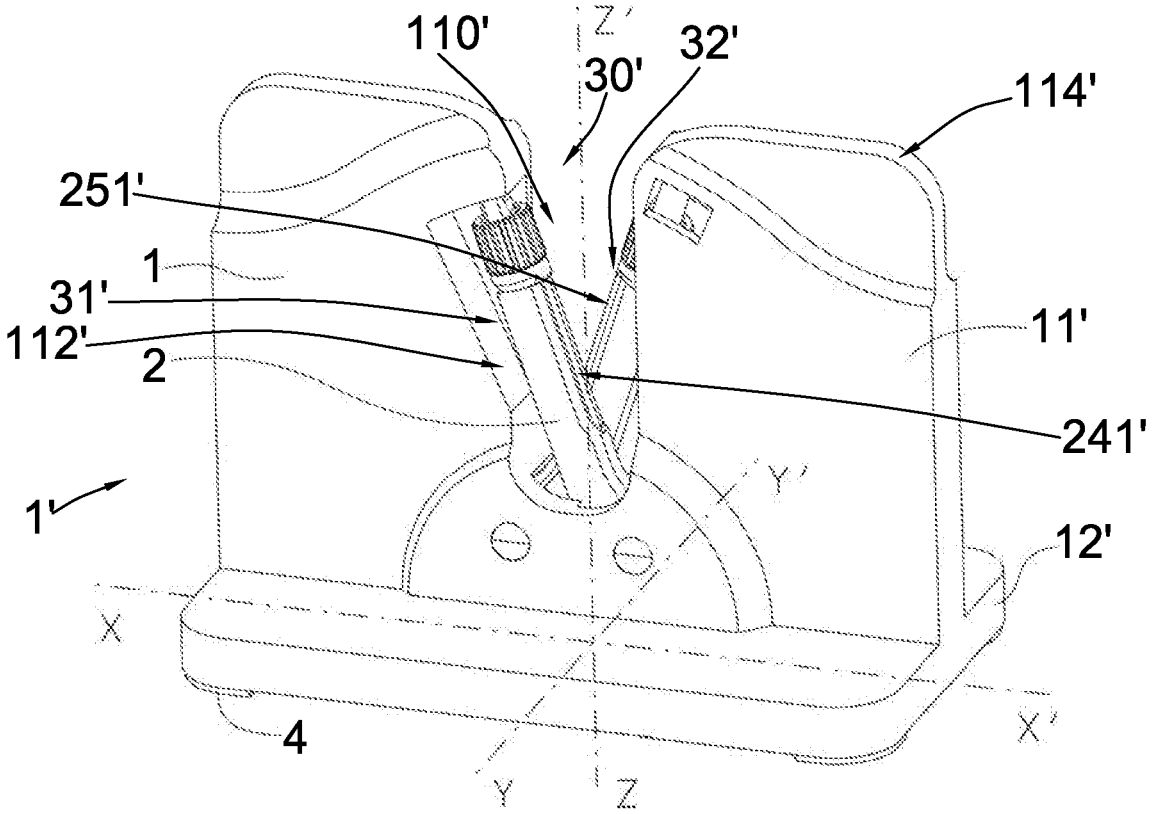
FIG. 12 is a perspective view of a knife sharpening device according to a second preferred embodiment of the present invention.

As shown in FIG. 12 of the drawings, the first supporting frame 23' and the second supporting frame 321' may be movably mounted in the main housing 1' to form an acute angle of inclination. The compression force exerted by the resilient element 6' may drive the first supporting frame 23' and the second supporting frame 321' to pivotally move about the first pivotal member 3' and the second pivotal member 323' respectively.

Figure 14:
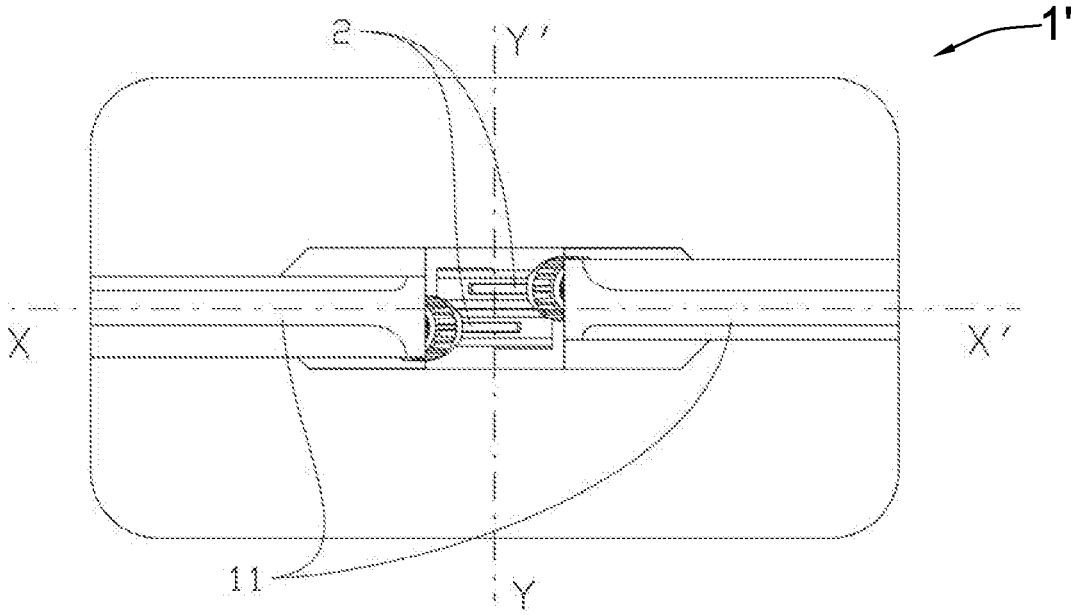
FIG. 14 is top view of the knife sharpening device according to the second preferred embodiment of the present invention.

As shown in FIG. 14 of the drawings, the knife sharpening device may be configured to be symmetrical along longitudinal axis X-X'. It may also be symmetrical along transverse axis Y-Y'. Moreover, the knife sharpening device may be configured to be symmetrical along vertical axis Z-Z'.

The operation of the present invention is as follows: a user may be able to dispose a cutting blade of a knife in the space created by the angle of inclination between the first supporting frame 23' and the second supporting frame 32'. The cutting blade may be arranged to come into contact with the exposed first sharpening edge 241' and the exposed second sharpening edge 251', so that the user may manually grind the cutting edge by pushing and pulling the cutting blade back and forth against the exposed first sharpening edge 241' and the exposed second sharpening edge 251'.

When the knife sharpening procedure is in process, the first supporting frame 23' and the second supporting frame 32' may be subject to the external force exerted by the user. This external force may overcome the resilient force of the resilient element 6' so that the first supporting frame 23' and the second supporting frame 32' may be pivotally moved with respect to the main housing 1'.

When the exposed first sharpening edge 241' and the exposed second sharpening edge 251' have been utilized for sharpening cutting blade for an extended period of time, they may become blunt. A user may then unscrew the first fastening knob 21' and the second fastening knob 3221' and release the first fastening ring 22' and the second fastening ring 3224' from the first supporting frame 23' and the second supporting frame 32' respectively. After that, the user may be able to detach the first knife sharpening blade 24' and the second knife sharpening blade 25' and re-install them in the first elongated slot 231' and the second elongated slot 3211' in such a manner that unused first sharpening edge 241' and unused second sharpening edge 251' may be arranged to expose out of the first supporting frame 23' and the second supporting frame 32' respectively. The user may then be able to tighten the re-installed first sharpening edge 241' and re-installed second sharpening edge 251' through tightening the first fastening ring 22' and the second fastening ring 3224' and then the first fastening knob 21' and the second fastening knob 3221'. The user may tighten the first fastening knob 21' and the second fastening knob 3221' through two windows 17' formed on the accommodating frame 11'.

The present invention, while illustrated and described in terms of the above preferred embodiments and several alternatives, is not limited to the particular description contained in this specification. Additional alternative or equivalent components could also be used to practice the present invention.

What is claimed is:

1. A knife sharpening device for a knife having a cutting blade, the knife sharpening device comprising:

a main housing;

a first knife sharpening blade having two first sharpening edges;

a second knife sharpening blade having two second longitudinal sharpening edges; and a blade replacement arrangement, which comprises:

a first supporting device movably and inclinedly supported by said main housing, said first knife sharpening blade being detachably supported on said first supporting device to expose one of said first sharpening edges out of said first supporting device, which is defined as an exposed first sharpening edge; and a second supporting device movably and inclinedly supported by said main housing, said second knife sharpening blade being detachably supported on said second supporting device to expose one of said second longitudinal sharpening edges out of said second supporting device, which is defined as an exposed second sharpening edge, said exposed first sharpening edge and said exposed second longitudinal sharpening edge being positioned to face each other to form a substantially V-shaped structure, wherein said cutting blade is adapted for being positioned between said exposed first sharpening edge and said exposed second longitudinal sharpening edge for being sharpened by said exposed first sharpening edge and said exposed second longitudinal sharpening edge, wherein said main housing comprises a base and an accommodating frame upwardly extended from said base, said accommodating frame having a first supporting surface, a second supporting surface, and an accommodating recess defined by said first supporting surface and said second supporting surface, said first supporting surface and said second supporting surface inclinedly extending from a top surface of said accommodating frame in such a manner that said first supporting surface and said second supporting surface forms an acute angle of inclination with respect to each other;

wherein said main housing further has a first receiving slot and a second receiving slot formed on said first supporting surface and said second supporting surface respectively, wherein said first supporting device and said second supporting device are partially supported in said first receiving slot and said second receiving slot respectively;

wherein said first knife sharpening blade has two first end portions and a first main portion extending between said two first end portions, each of said two first end portions of said first knife sharpening blade having a first indented recess, said first sharpening edges being formed on two longitudinal edges of said first main portion of said first knife sharpening blade;

wherein said first supporting device comprises a first supporting frame having a first elongated slot, and a first mounting mechanism provided on said first supporting frame to detachably mount said first knife sharpening blade in said first elongated slot, said first mounting mechanism comprising a first fastening knob and a first fastening ring, said first supporting frame further having a first connecting portion detachably connecting to said first fastening knob, said first connecting portion being externally threaded while said first fastening knob having a first bored hole for threadedly connecting to said first connecting portion of said first supporting frame;

wherein said first fastening ring has a first ring body, a through first central opening formed on said first ring body, and a first protrusion downwardly extended from said first ring body, said first connecting portion being arranged to penetrate through said first central opening to threadedly connect with said first bored hole of said first fastening knob, said first protrusion being positioned to correspond to said first indented recess so that when said first knife sharpening blade is accommodated in said first elongated slot, said first fastening knob is threadedly tightened on said first connecting portion so as to push said first protrusion to bias against a boundary of said first indented recess.

2. The knife sharpening device, as recited in claim 1, wherein said first supporting device further comprises a first pivotal member provided on a first lower portion of said first supporting frame for pivotally connecting said first supporting frame to said main housing.

3. The knife sharpening device, as recited in claim 2, wherein said second knife sharpening blade has two second end portions and a second main portion extending between said two second end portions, each of said two second end portions of said second knife sharpening blade having a second indented recess, said second sharpening edges being formed on two longitudinal edges of said second main portion of said second knife sharpening blade.

4. The knife sharpening device, as recited in claim 3, wherein said second supporting device comprises a second supporting frame having a second elongated slot, and a second mounting mechanism provided on said second supporting frame to detachably mount said second knife sharpening blade in said second elongated slot, said second mounting mechanism comprising a second fastening knob and a second fastening ring, said second supporting frame further having a second connecting portion detachably connecting to said second fastening knob, said second connecting portion being externally threaded while said second fastening knob having a second bored hole for threadedly connecting to said second connecting portion of said second supporting frame.

5. The knife sharpening device, as recited in claim 4, wherein said second fastening ring has a second ring body, a through second central opening formed on said second ring body, and a second protrusion downwardly extended from said second ring body, said second connecting portion being arranged to penetrate through said second central opening to threadedly connect with said second bored hole of said second fastening knob, said second protrusion being positioned to correspond to said second indented recess so that when said second knife sharpening blade is accommodated in said second elongated slot, said second fastening knob is threadedly tightened on said second connecting portion so as to push said second protrusion to bias against a boundary of said second indented recess.

6. The knife sharpening device, as recited in claim 5, wherein said second supporting device further comprises a second pivotal member provided on a second lower portion of said second supporting frame for pivotally connecting said second supporting frame to said main housing.

7. The knife sharpening device, as recited in claim 6, wherein said blade replacement arrangement further comprises a resilient element connecting said first lower portion to said second lower portion, wherein said resilient element is arranged to exert a compression force toward said first lower portion and said second lower portion.

8. The knife sharpening device, as recited in claim 7, wherein said first supporting frame further has a first supporting portion and a first securing portion extended from said first supporting portion for partially and movably receiving in said first receiving slot of said main housing, wherein said first elongated slot is formed in said first supporting portion, said first securing portion extending in a direction toward said first receiving slot, whereas said first connecting portion and said first lower portion upwardly and downwardly extending from said first supporting portion respectively.

9. The knife sharpening device, as recited in claim 8, wherein said second supporting frame further has a second supporting portion and a second securing portion extended from said second supporting portion for partially and movably receiving in said second receiving slot of said main housing, wherein said second elongated slot is formed in said second supporting portion, said second securing portion extending in a direction toward said second receiving slot, whereas said second connecting portion and said second lower portion upwardly and downwardly extending from said second supporting portion respectively.

* * * * *